US006173151B1

(12) United States Patent
Ream et al.

(10) Patent No.: US 6,173,151 B1
(45) Date of Patent: Jan. 9, 2001

(54) ELECTROSTATIC FUSER WITH POST-NIP ELECTRICALLY BIASED DISCHARGE MEMBER

(75) Inventors: Gregory L. Ream, Lexington; Steven A. Curry, Nicholasville, both of KY (US)

(73) Assignee: Lexmark International, Inc., Lexington, KY (US)

( * ) Notice: Under 35 U.S.C. 154(b), the term of this patent shall be extended for 0 days.

(21) Appl. No.: 09/483,616

(22) Filed: Jan. 14, 2000

(51) Int. Cl.[7] ..... G03G 15/20; G03G 15/16; H05B 1/00

(52) U.S. Cl. ..... 399/324; 219/216; 399/122; 399/322

(58) Field of Search ..... 219/216; 118/60; 399/67, 310, 322, 324, 328, 329, 330, 331

(56) References Cited

U.S. PATENT DOCUMENTS

| | | | |
|---|---|---|---|
| 4,320,714 | 3/1982 | Shimazaki et al. | 118/60 |
| 4,434,355 | 2/1984 | Inagaki et al. | 219/216 |
| 4,525,058 | 6/1985 | Hirabayashi et al. . | |
| 4,616,917 | 10/1986 | Sakurai . | |
| 4,640,600 | 2/1987 | Hirabayashi et al. . | |
| 5,045,891 | 9/1991 | Senba et al. . | |
| 5,253,024 | 10/1993 | Okuda et al. . | |
| 5,287,153 | 2/1994 | Senba . | |
| 5,722,012 | 2/1998 | Saitoh | 399/99 |

FOREIGN PATENT DOCUMENTS

| | | | |
|---|---|---|---|
| 59-152473 | * | 8/1984 | (JP) . |
| 7-146618 | * | 6/1995 | (JP) . |
| 8-272245 | * | 10/1996 | (JP) . |

* cited by examiner

*Primary Examiner*—Arthur T. Grimley
*Assistant Examiner*—Hoang Ngo
(74) *Attorney, Agent, or Firm*—John A. Brady

(57) ABSTRACT

An image-fixing device for use in an electrophotographic process which includes an electrode (discharge member) on the exit side of a fuser mechanism is disclosed. This mechanism eliminates toner offset without requiring reformulation of the fuser or pressure rollers or restructuring of the fuser, and without compromising the release properties of those rollers. The preferred electrode has a saw-tooth configuration and is placed close to, but not contacting, the pressure roller and the back side of the printed page. A voltage, typically from about 200 to about 1,000 volts is applied to that electrode; the voltage has a polarity which is opposite the charge of the toner on the printed page.

16 Claims, 3 Drawing Sheets

ELECTROSTATIC FUSER WITH POST-NIP ELECTRICALLY BIASED DISCHARGE MEMBER

TECHNICAL FIELD

This invention relates to electrophotographic processes and, particularly, to the prevention of toner offset from hot rolls and belts used in the fusing step of such processes.

BACKGROUND OF THE INVENTION

In electrophotography, a latent image is created on the surface of an insulating, photoconducting material by selectively exposing an area of the surface to light. A difference in electrostatic charge density is created between the areas on the surface exposed and those unexposed to the light. The latent electrostatic image is developed into a visible image by electrostatic toners containing pigment components and thermoplastic components. The toners, which may be liquids or powders, are selectively attracted to the photoconductor's surface, either exposed or unexposed to light, depending upon the relative electrostatic charges on the photoconductor's surface, development electrode, and the toner. The photoconductor may be either positively or negatively charged, and the toner system similarly may contain negatively or positively charged particles.

A sheet of paper or intermediate transfer medium is given an electrostatic charge opposite that of the toner and then passed close to the photoconductor's surface, pulling the toner from the photoconductor surface onto the paper or intermediate medium still in the pattern of the image developed from the photoconductor surface. A set of fuser rolls or belts, under heat, melts and fixes the toner in the paper, subsequent to direct transfer or indirect transfer when an intermediate transfer medium is used, producing the printed image.

The electrostatic printing process, therefore, comprises an ongoing series of steps in which the photoconductor surface is charged and discharged as the printing takes place. In addition, during the process, various charges are formed on the photoconductor surface, the toner and the paper surface to enable the printing process to take place. Having the appropriate charges in the appropriate places at the appropriate times is what makes the process work.

Contamination of print media arises in electrophotographic printers and copiers as a result of charge accumulation on the fuser hot roll or belt and the associated pressure roll. This contamination results from the offset of toner from the print media onto the contacting fuser hot roll or belt due to unfavorable electrostatic fields in and around the fusing nip (i.e., the nip formed between the fuser roll or belt and the pressure roll). This contamination ("toner offset") results in a printed page of poor quality, generally characterized by the appearance of undesired white lines followed by toner debris after one additional revolution of the fuser hot roll or belt.

Clearly, the toner offset problem is a very important one in electrostatic printing and, accordingly, a number of solutions to it have been proposed, including:

(1) Adding a conductive agent in the form of carbon black or an ionic conductive additive to the release layer coating of the fuser roll (or belt), pressure roll, or both. This results in decreased electrostatic charge accumulation on the fuser member, but also results in some loss of release properties as compared to an unfilled fluoropolymer coating. The underlying conductive layer of the hot roll or belt in those structures is typically grounded. See, for example, U.S. Pat. No. 5,045,891, issued Sep. 3, 1991 (single crystal (carbon and other) fibers in Teflon outer layer of hot roll); U.S. Pat. No. 4,434,355, issued Feb. 28, 1984 (rough primer layer containing conductive fibers penetrates the outer layer roll); and U.S. Pat. No. 4,320,714, issued Mar. 23, 1982 (pressure roll with grounded electroconductive layer beneath insulating PFA or silicone outer layer).

(2) Applying a biased voltage to the conductive hot roll (or belt) substrate or to the pressure roll core, or both. In this case, the roll or belt surface coating needs to have either a short time constant (resistive) or a dielectric breakdown voltage to applied bias to enable the bias voltage to be effective. Underlying layers between the bias electrode and the surface coating also need to provide a current path to the coating layer. The external bias is applied (or allowed to develop triboelectrically, using diodes) in a direction which keeps toner on the print media. This method is utilized, in conjunction with a silicone covered heat roll and a resistive-rubber core, PFA-sleeved pressure roller, in the HP SXIII printer from Canon.

(3) Adding a tribocharging surface-active agent to the pressure roll surface in an attempt to reverse the tendency to accumulate electrostatic charge of the wrong sign on the pressure roll. For instance, a fluoropolymer-sleeved pressure roll tends to tribocharge negative when scrubbed against paper. When used in a system with negative toner, a tribocharging surface-active agent would need to cause the fluoropolymer coating to charge positive, rather than negative. See, for example, U.S. Pat. Nos. 4,616,917 and 4,640,600, issued Oct. 14, 1986.

(4) Using a discharge brush touching or adjacent to the surface of the pressure roll. In this case, a discharge brush introduces wear to the roll surface, and plays an unintended contamination collection role, both of which are undesirable. Charge removal from the thick rubber-covered pressure roll is also ineffective at preventing charge accumulation on the hot roll or belt, consequently not completely solving the electrostatic contamination problem.

U.S. patent application Ser. No. 09/393,571, filed Sep. 10, 1999, discloses heat rolls and fuser belts which seek to minimize toner offset while still maintaining excellent release characteristics of the printed page from the fuser. The heat rolls comprise a core member having coated thereon a plurality of concentric layers, wherein at least one of said layers (preferably the top layer) does not contain electrically-conductive materials, and wherein the roll exhibits electrical breakdown at about 250 volts or less.

U.S. Pat. No. 5,722,012, Saitoh, issued Feb. 24, 1998, describes the use of a toner removing device positioned between the image-forming portion and the toner fixing portion of the printer. The device produces an electrical charge opposite the charge of the toner on the printed page, and its purpose is to remove (by electrostatic attraction) toner from the back of the page. There is no discussion about the effect of this device on minimizing toner offset from the front of the page.

U.S. Pat. No. 5,287,153, Senba, issued Feb. 15, 1994, describes a method for minimizing toner offset in a printer. The second embodiment described (see FIG. 4) appears to have conductive needles which contact the paper, removing the positive charge from the paper and applying it to the conductive base of the fixing roller. This embodiment does not apply a biasing voltage to the paper.

U.S. Pat. No. 4,525,058, Hirabayashi, et al., issued Jun. 25, 1985, describes a charge removing means which is located at the exit side of the fixing rollers in a printer. The charge removing means consist of conductive needles which are placed near (but not in contact with) the printed sheet. The needles are grounded and act to remove any charge from the paper. No biasing voltage is applied to the paper.

U.S. Pat. No. 5,253,024, Okuda, et al., issued Oct. 12, 1993, describes a charge removing brush which contacts the backside of the printed page, removing accumulated charge via grounding (see FIG. 8). There is no charge directly applied to the printed page in this embodiment.

It has now been found that toner offset can be minimized, without compromising the release properties of the fuser roll, by placing an electrode (i.e., a discharge member) adjacent to the fuser nip exit and the back side of the printed page, such that the electrode provides to the page a bias voltage of opposite polarity to the charge of the toner on the page. This approach not only minimizes toner offset, but it does so without requiring reformulation of the fuser hot roll or pressure roll coverings, and, further, without compromising the release properties of the printed page from the fuser roll or pressure roll.

SUMMARY OF THE INVENTION

The present invention comprises an image-forming device, comprising:

first and second rotatable members forming a nip therebetween, which transport from an entrance side through said nip to an exit side a recording material, thereby fixing toner to create an image on said recording material;

means for driving at least one of said first and second rotatable members; and an electrode located on the exit side of said nip adjacent to the non-image carrying side of said recording material, said electrode providing an electric voltage in proximity to said recording material of a polarity opposite that of the toner. Preferred electrodes (discharge members) are in the form of a brush, a saw tooth structure or a wire, with the saw tooth structure being particularly preferred. The electrodes preferably carry a positive voltage of from about 200 to about 1,000 volts, most preferably from about 400 to about 600 volts.

DETAILED DESCRIPTION OF THE INVENTION

The present invention relates to the inclusion of an electrode (i.e., a discharge member) at the exit nip of a fuser hot roll or belt which is used to fix images in an electrophotographic process. By using this electrode to impart a voltage to the printed page, which is opposite in polarity to the charge of the toner on the page, toner offset problems inherent in the printing process can be overcome without requiring major reformulations of the hot fuser roll or belt, or restructuring of the printer design.

Figure 1:
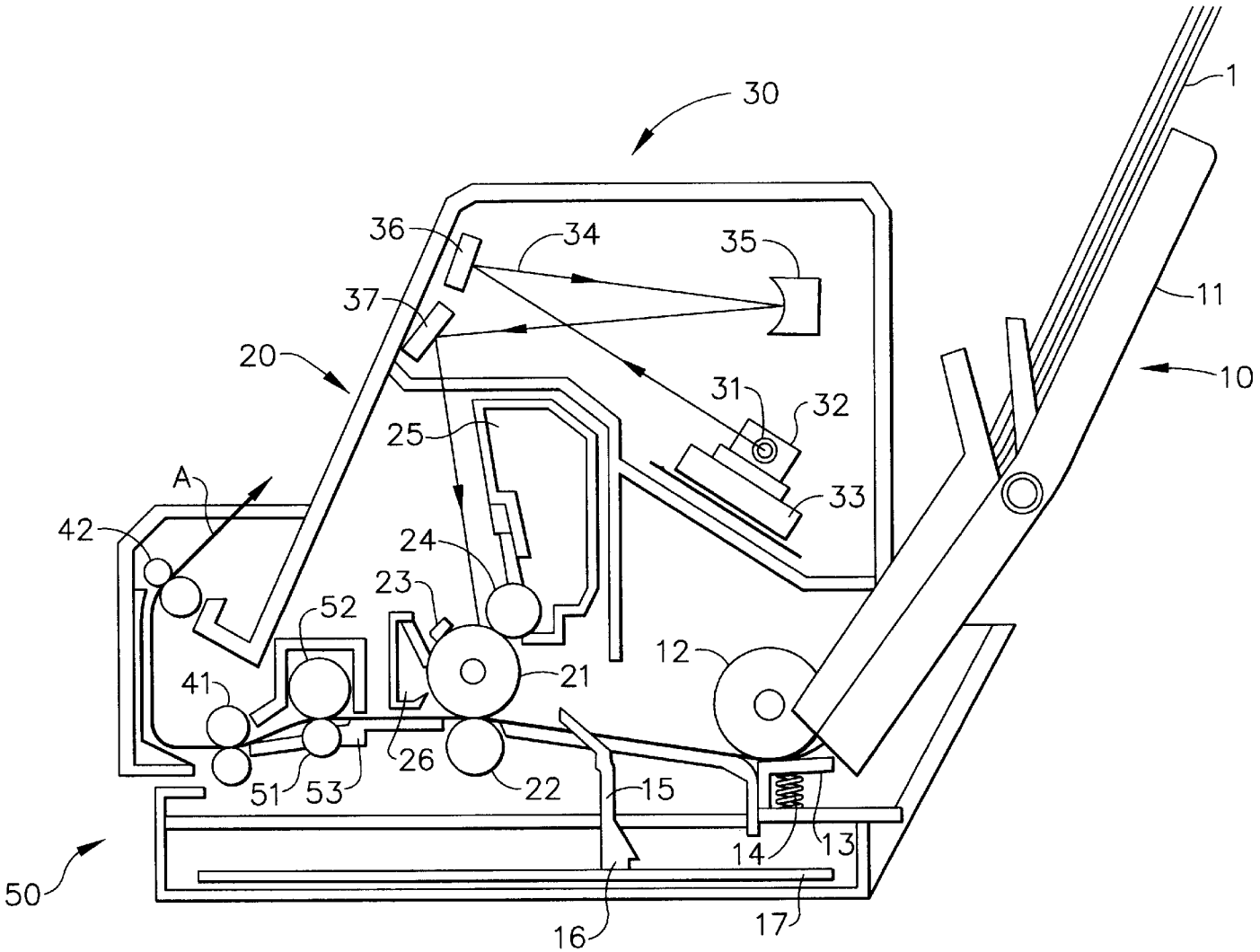
FIG. 1 is a schematic view of a laser printer representing a typical electrophotographic apparatus.

A standard design for a laser printer, a representative electrophotographic device, is shown in FIG. 1. It includes a paper feed section (10), an image-forming device (20), a laser scanning section (30), and a fixing device (50). The paper feed section (10) sequentially transports sheets of recording paper (1) to the image-forming device (20) provided in the printer. The image-forming device (20) transfers a toner image to the transported sheet of recording paper (1). The fixing device (50) fixes toner to the sheet of recording paper (1) sent from the image-forming device (20). Thereafter, the sheet of recording paper (1) is ejected out of the printer by paper transport rollers (41 and 42). In short, the sheet of recording paper (1) moves along the path denoted by the arrow (A) in FIG. 1.

The paper feed section (10) includes a paper feed tray (11), a paper feed roller (12), a paper separating friction plate (13), a pressure spring (14), a paper detection actuator (15), a paper detection sensor (16), and a control circuit (17).

Upon receiving a print instruction, the sheets of recording paper (1) placed in the paper feed tray (11) are fed one-by-one into the printer by operation of the printer feed roller (12), the paper separating friction plate (13) and the pressure spring (14). As the fed sheet of recording paper (1) pushes down the paper detection actuator (15), the paper detection sensor (16) outputs an electrical signal instructing commencement of printing of the image. The control circuit (17), started by operation of the paper detection actuator (15), transmits an image signal to a laser diode light-emitting unit (31) of the laser scanning section (30) so as to control on/off of the light-emitting diode.

The laser scanning section (30) includes the laser diode light-emitting unit (31), a scanning mirror (32), a scanning mirror motor (33), and reflection mirrors (35, 36 and 37).

The scanning mirror (32) is rotated at a constant high speed by the scanning mirror motor (33). In other words, laser light (34) scans in a vertical direction to the paper surface of FIG. 1. The laser light (34) radiated by the laser diode light emitting unit (31) is reflected by the reflection mirrors (35, 36 and 37) so as to be applied to photo-sensitive body (21). When the laser light (34) is applied to the photo-sensitive body (21), the photo-sensitive body (21) is selectively exposed to the laser light (34) in accordance with on/off information from the control circuit (17).

The image-forming device (20) includes the photo-sensitive body (21), a transfer roller (22), a charging member (23), a developing roller (24), a developing unit (25), and a cleaning unit (26). The surface charge of the photo-sensitive body (21), charged in advance by the charging member (23) is selectively discharged by the laser light (34). An electrostatic latent image is thus formed on the surface of the photo-sensitive body (21). The electrostatic latent image is visualized by the developing roller (24) and the developing unit (25). Specifically, the toner supplied from the developing unit (25) is adhered to the electrostatic latent image on the photosensitive body (21) by the developing roller (24) so as to form the toner image.

Toner used for development is stored in the developing unit (25). The toner contains coloring components (such as carbon black for black toner) and thermoplastic components. The toner, charged by being appropriately stirred in the developing unit (25), adheres to the above-mentioned electrostatic latent image by an interaction of the developing bias voltage applied to the developing roller (24) and an electric field generated by the surface potential of the photo-sensitive body (21), and thus conforms to the latent image, forming a visual image on the photo-sensitive body (21). The toner typically has a negative charge when it is applied to the latent image forming the visual image.

Next, the sheet of recording paper (1) transported from the paper feed section (10) is transported downstream while being pinched by the photo-sensitive body (21) and the transfer roller (22). The paper (1) arrives at the transfer nip in timed coordination with the toned image on the photo-sensitive body (21). As the sheet of recording paper (1) is transported downstream, the toner image formed on the photo-sensitive body (21) is electrically attracted and transferred to the sheet of recording paper (1) by an interaction with the electrostatic field generated by the transfer voltage applied to the transfer roller (22). The toner that still remains on the photo-sensitive body (21), not having been transferred to the sheet of recording paper (1), is collected by the cleaning unit (26).

Thereafter, the sheet of recording paper (1) is transported to the fixing device (50). In the fixing device (50), an appropriate temperature and pressure are applied while the sheet of recording paper (1) is being pinched by moving through the nip formed by a pressure roller (51) and the fixing roller (52) (or belt) that is maintained at a constant temperature. The thermoplastic components of the toner are melted by the fixing roller (52) and fixed to the sheet of recording paper (1) to form a stable image. The sheet of recording paper (1) is then transported and ejected out of the printer by the printer transport rollers (41 and 42).

Next, the operation of the fixing device (50) will be described in detail. The fixing device (50) includes the pinch (or pressure) roller (51) and the fixing (or, in some embodiments, a fixing belt) roller (52). The fixing roller (52) is generally composed of a hollow cylinder made from a material which conducts heat, such as aluminum, and the outer surface of which is coated with a synthetic resin material having good toner release, paper transport and heat resistance properties. An example of this coating is the synthetic resin material fluororesin for its toner release properties, used together with the heat resistant rubber, such as a silicone rubber for its good paper transport properties. These materials are mixed, applied to the surface of the roller and then baked. The roller is made from a material which conducts heat and which has sufficient structural integrity such that it maintains its shape when it is used against a pressure roller (51) to form a nip through which the printed pages travel. Typically, the pressure between the fuser roller (52) and the pressure roller (51) is from about 10 to about 30 psi. The fuser roller (52) is generally made from materials having a high thermal conductivity and a relatively high thermal capacity. Preferred materials are those selected from aluminum, copper, steel and mixtures thereof. The most preferred material is aluminum, because of its excellent thermal properties and its relatively low cost. A heater lamp is placed within the hollow portion of the fuser roll (52). The heater lamp serves as the means by which the fuser roll (52) is heated during use. The fuser portion of the printer may utilize a fuser belt which is heated by, for example, a ceramic heater, in place of the fuser roller (52). Such belts are well known in the electrophotography art.

The pressure roller (51) is also cylindrical in shape. It is made from or is coated with a material that has good release and transport properties for the recording paper (1). The pressure roller (51) is sufficiently soft so as to allow it to be rotated against the fuser roller (52) to form a nip through which the printed pages travel. By going through this nip, printed pages are placed under pressure and the combined effects of this pressure and the heat from the fuser roller (52) (or belt) act to fix the toner onto the paper. A preferred material for use in forming the pressure roller (51) is silicone rubber. The roller typically has an aluminum core with a silicone rubber layer molded or adhesively bonded onto its surface. This roller may also have a fluoropolymer sleeve or coating.

Figure 2:
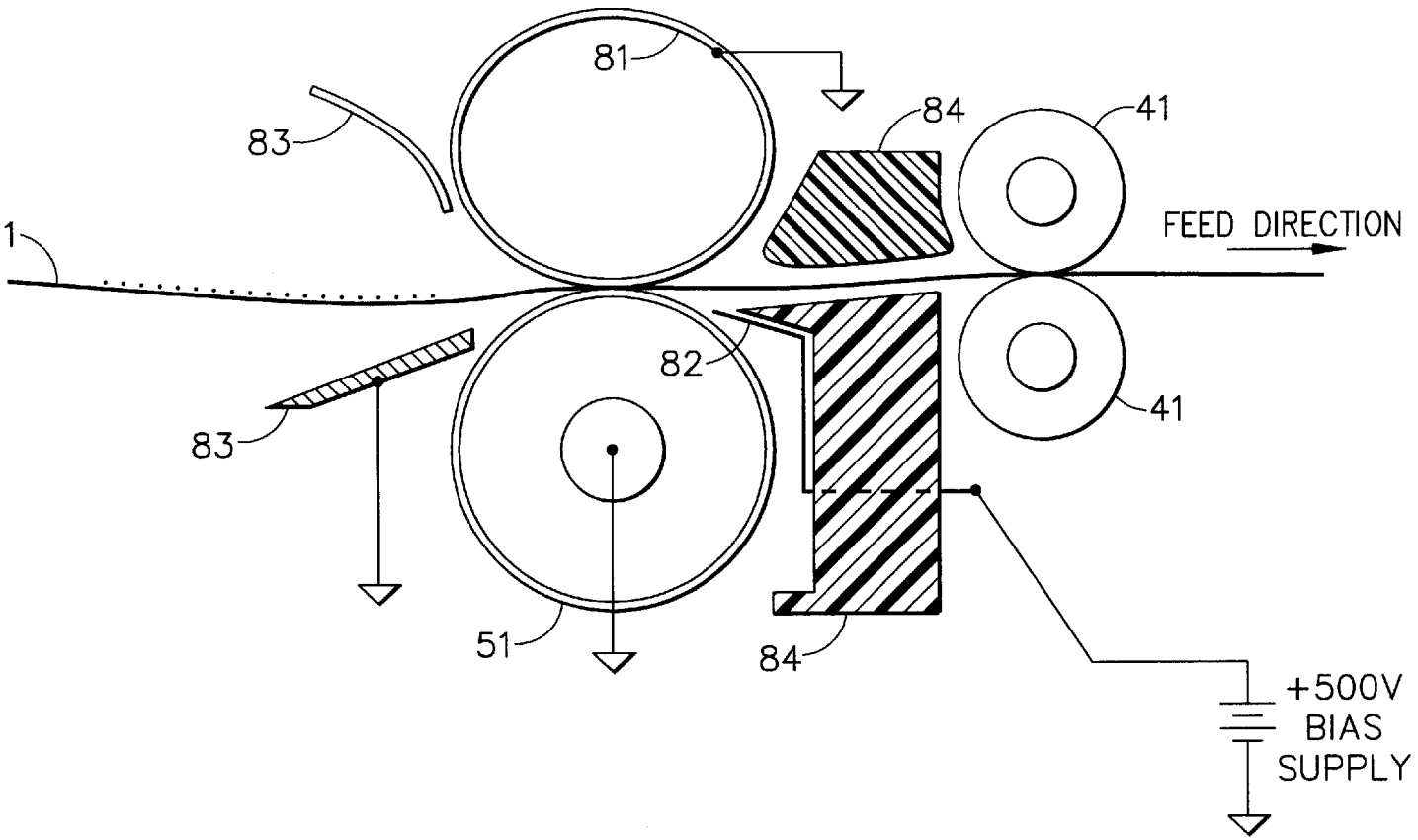
FIG. 2 is a schematic cross-section view of a belt fuser with a pressure roll of the present invention which incorporates a saw-tooth post-nip discharge member.

A fuser belt which incorporates the post-nip discharge member (electrode) of the present invention is illustrated in cross-section in FIG. 2. Additional detail of the preferred saw-tooth discharge member position is shown in cross-section in FIG. 3 and a sketch of the preferred saw-tooth discharge member is shown in FIG. 4.

With reference to FIG. 2, a belt fuser (81) is shown with a nip created between the belt and the pressure roll (51). In the preferred embodiment, the belt has a fluoropolymer coating of PFA or a PTFE/PFA blend. This coating has no fillers that would interfere with the toner release properties of the coating. The belt dielectric breakdown voltage is approximately 964 volts for a 12 $\mu$M thick coating. The inner layer of the belt is grounded. The pressure roll (51) has a metal shaft, a compliant rubber layer, and a fluoropolymer sleeve of PFA. The dielectric breakdown voltage attributable to a 2 mil thick PFA sleeve on the pressure roll is at least 4,000 volts. An underlying insulating, compliant, silicone rubber layer (2.5 mm thick) allows the surface potential on the pressure roll (51) to rise to a voltage greater than 10,000 volts without dielectric breakdown. The shaft of the pressure roll is grounded. Also in this figure, dots are used to denote the fact that, before the fuser entrance nip, the print media (1) carries unfused toner on its side facing the fuser belt (81). The upper and lower entry guides (83) are made from conductive plastic, and the upper and lower exit guides (84) are non-conductive.

The electrode (discharge member) (82) is preferably mounted such that it is not touching either of the rotatable fixing members. It is also mounted such that it is not touching the recording material (i.e., paper) (1) itself. The electrode (82) is located between one of said rotatable members (generally the pressure roll (51)) and the non-image carrying side (i.e., the back side) of the recording material (1). The electrode (82) is located such that it provides an electric voltage in proximity to the recording material (1). The electrode (82) is generally located from about 1 mm to about 10 mm away from the exit point of the nip at its closest point in the process direction; it is generally located from about 0.5 mm to about 3 mm away from the recording material (1) at its closest point. It is preferred that the electrode (82) be from about 4 to about 7 mm at its closest point away from the rotatable members, and preferably from about 1 mm to about 2 mm at its closest point away from the back side of the recording material (1). The electrode (82) can be in any shape that is convenient to fit in the fusing apparatus. Brushes, a substantially flat saw-tooth configuration, and a straight wire are examples of suitable electrode shapes, with the saw-tooth configuration being preferred. The saw-tooth discharge member (82) in FIG. 2 is flat, extends across the back of the print media (1) in a direction perpendicular to the direction the print media (1) moves through the fuser nip, and is mounted to a non-conductive exit guide (84) so that the tips of the saw teeth are approximately 1.5 mm from the back side of the print media (1), opposite the toned surface. In this embodiment, the saw teeth are approximately 6 mm from the nip exit in the process direction and about 1.5 mm from the surface of the pressure roll (51). The voltage applied to the electrode (82) is generally from about 200 to about 1,000 volts, preferably from about 400 to about 600 volts. The voltage applied is opposite in polarity to the charge of the toner which is being carried by the recording media (1). Thus, if the toner is negatively charged, as is generally the case, the electrode voltage is positive. In a preferred embodiment, a nominal +500 volt bias power supply with a nominal 10 $\mu$A current capability is attached to the saw-tooth electrode (82) to provide a source of positive charge.

Figure 3:
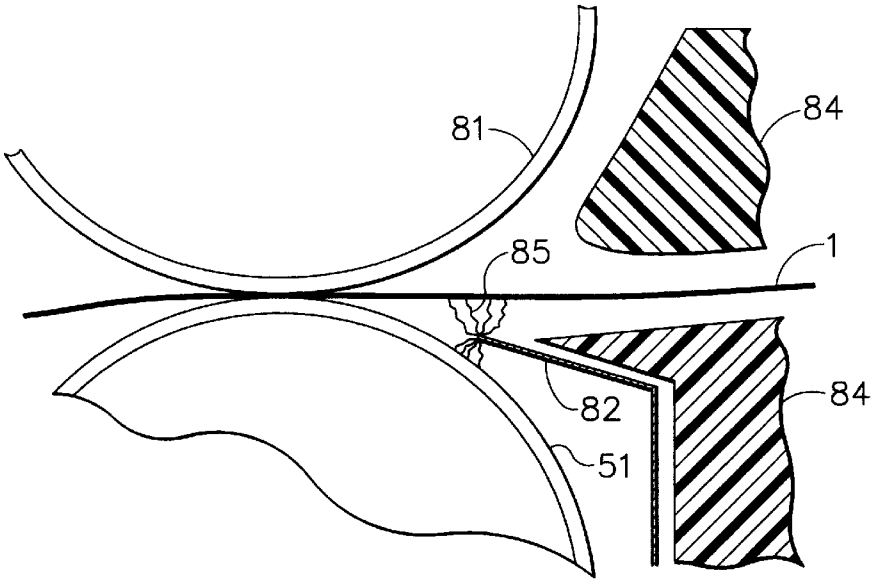
FIG. 3 is a close-up of FIG. 2 showing the detail of the saw-tooth discharge member of the present invention illustrating its proximity to the print media and the pressure roll.
Figure 4:
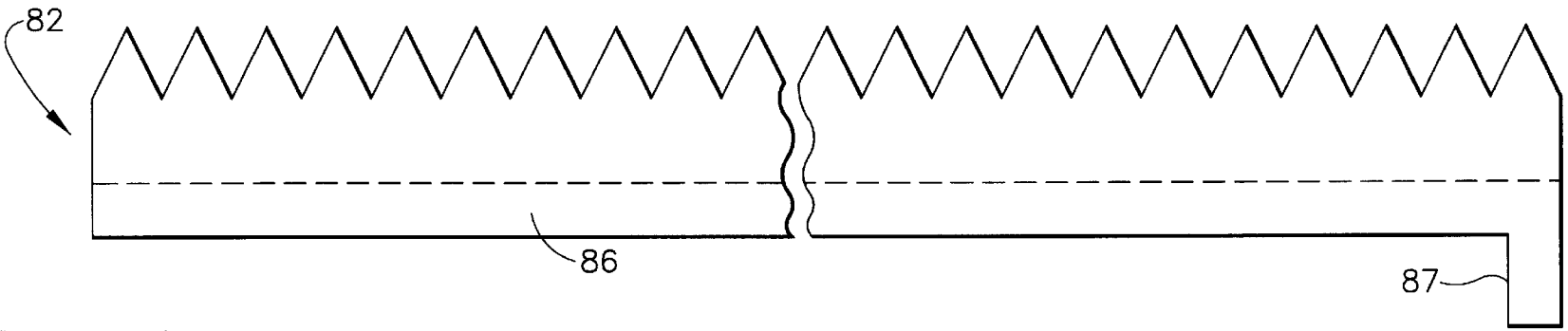
FIG. 4 shows the detail of the preferred saw-tooth discharge member used in the present invention.

FIG. 3 illustrates the field lines (85) between the saw-tooth discharge member (82) and the print media (1) and pressure roll (51). Charge flows from the discharge element (82) to the print media (1) and to the pressure roll (51) when the electric field strength is sufficient to cause localized air ionization. The "razor" sharp saw teeth, illustrated in FIG. 4, create an intense electric field in the vicinity of the punch-cut edges, sufficient to initiate air ionization with a potential difference of approximately 1,000 volts over the 1.5 mm gap between the saw teeth and the print media (1). In FIG. 4, the electrode is made from 0.2 mm thick stainless steel, punch cut to form sharp teeth. The teeth are spaced apart 2 mm from point to point and are 2 mm deep. The straight edge of the electrode (86) may be bent for stiffness and straightness. A connector tab (87) is used to connect the electrode to the bias power supply. The potential on the print media (1) in the vicinity of the saw-tooth discharge member (82) is determined by:

(1) the conductivity of the media to any of the rollers, belts or surfaces with which it is in contact (e.g., the fuser belt and pressure roller), and (2) the distribution of charge on and around the print media in relation to surrounding conductors. Correspondingly, the selected design places the discharge element (a) near the print media where the conductive path through the print media to the fuser nip is short, and (b) where no other conductors are closer to the print media than is the discharge member.

The likelihood of the paper (1) hitting the discharge member (82) is a second set of design constraints on the placement of the discharge member (82). Locating the saw tooth close (e.g., about 1.5 mm) to the pressure roll (51) in the radial direction and 6 mm in the process direction from the fuser nip exit gives the print media (1) an opportunity to detach from the pressure roll (51) and results in an acceptably low probability of the print media (1) striking or jamming into the discharge member (82).

The electrostatic field associated with the discharge member and the corresponding charge flow from the discharge member to the print media with conduction of that charge to the fuser belt and the print media nip exit is responsible for preventing electrostatic toner offset from the print media to the fuser belt (or hot roll). This has been demonstrated empirically using the following procedure.

A laser printer as shown in FIG. 1 is provided with a discharge member of sawtooth design attached to an adjustable bias power supply. The sawtooth is positioned 10 mm from the roller nip and 1.5 mm from the backside of the paper.

The test is run with the fuser temperature reduced to a level that does not thermally fix the negatively charged toner to the paper. In this test condition, the effect of electrostatic forces is greatly exaggerated. A series of three prints is produced on three sheets of a rough, 16 pound paper. The first two prints are lightly toned and serve to triboelectrically charge the fuser. The last print is an all black print used to assess the contamination performance of the fuser and discharge member.

Using this test, the following results are obtained.

(1) No bias source connection to the saw tooth (baseline test): visually objectionable amount of toner is transferred from the paper to the fuser belt. Shows "white line" defect. (Poor result)

(2) Bias source at −500 volts: approximately 40% of toner is transferred from the paper to the fuser belt, but only after the leading edge of the paper reaches the discharge member. (Unacceptable result)

(3) Bias source at +200 volts to +1,000 volts: no noticeable quantity of toner is removed from the paper. No "white line" defect. (Good Result)

(4) Bias source at +500 volts with extended running during which charge is allowed to accumulate on fuser roll: some "white line" defects visible in top 10 mm of page, corresponding to leading edge of paper not reaching the discharge member until 10 mm beyond the fuser nip. (Acceptable result)

The proximity of the discharge member to the pressure roll is expected to result in at least a partial discharge of the surface charge accumulated on this roll. Because the PFA sleeve and underlying insulating, silicone rubber, compliant layer are thick, a very small amount of charge on the roll surface produces a large voltage in the vicinity of the discharge member. This results in air ionization and a flow of neutralizing positive charge in the case of a negative charge accumulation.

The saw-tooth discharge member is the preferred choice for the fuser post-nip discharge element. It is functional, rugged, non-contacting, and can be accurately placed. It is preferred that the discharge element utilized extend across the back of the recording material perpendicular to the direction of travel of the material through the fuser. Alternative discharge elements include a discharge brush (less accuracy in placement with possible contact of the pressure roll), and a 2–4 mil diameter tungsten or gold-plated tungsten wire (very delicate).

What is claimed is:

1. An image-fixing device comprising:

first and second rotatable members forming a nip therebetween, which transport from an entrance side through said nip to an exit side a recording material, thereby fixing toner to create an image on said recording material;

means for driving at least one of said first and second rotatable members; and an electrode located on the exit side of said nip adjacent to the non-image carrying side of said recording material, a power supply connected to said electrode to provide an electric bias voltage in proximity to said recording material of a polarity opposite that of the toner, said electrode not touching the recording material as it moves through the nip.

2. An image-fixing device according to claim 1 wherein the electrode is not touching either of said rotatable members.

3. An image-fixing device according to claim 1 wherein the electrode is located between one of said rotatable members and the non-image carrying side of said recording material.

4. An image-fixing device according to claim 3 wherein the electrode is located, at its closest point, from about 1 mm to about 10 mm away from the nip in the process direction.

5. An image-fixing device according to claim 4 wherein the electrode is located, at its closest point, from about 0.5 mm to about 3 mm away from the recording material.

6. An image-fixing device according to claim 5 wherein the voltage is from about 200 to about 1,000 volts.

7. An image-fixing device according to claim 6 wherein the voltage is positively charged.

8. An image-fixing device according to claim 7 wherein the electrode is selected from the group consisting of a brush, a saw-tooth configuration, and a wire.

9. An image-fixing device according to claim 8 wherein the electrode is located, at its closest point, from about 4 mm to about 7 mm away from the nip in the process direction.

10. An image-fixing device according to claim 9 wherein the electrode is located, at its closest point, from about 1 mm to about 2 mm away from the recording material.

11. An image-fixing device according to claim 10 wherein the voltage is from about 400 to about 600 volts.

12. An image-fixing device according to claim 11 wherein the electrode is a saw-tooth configuration.

13. An image-fixing device according to claim 8 wherein the electrode extends across the back of the recording material perpendicular to the direction of its travel through the nip.

14. An image-fixing device according to claim 3 wherein the electrode is selected from the group consisting of a brush, a saw-tooth configuration, and a wire.

15. An image-fixing device according to claim 14 wherein the electrode is a saw-tooth configuration.

16. An image-fixing device according to claim 3 wherein the electrode extends across the back of the recording material perpendicular to the direction of its travel through the nip.

* * * * *